US007497193B2

(12) United States Patent
Knecht et al.

(10) Patent No.: US 7,497,193 B2
(45) Date of Patent: Mar. 3, 2009

(54) ROTOR OF A CAMSHAFT ADJUSTER

(75) Inventors: Andreas Knecht, Kusterdingen (DE); Dirk Pohl, Tuebingen (DE); Jan Eimert, Esslingen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 77 days.

(21) Appl. No.: 11/655,767

(22) Filed: Jan. 18, 2007

(65) Prior Publication Data

US 2007/0175426 A1 Aug. 2, 2007

(30) Foreign Application Priority Data

Jan. 18, 2006 (DE) ..... 10 2006 002 599
Apr. 24, 2006 (DE) ..... 10 2006 019 435
Jan. 17, 2007 (EP) ..... 07100664

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 5,823,152 A 10/1998 Ushida
5,832,887 A 11/1998 Adachi et al.
5,960,757 A 10/1999 Ushida
6,330,870 B1 * 12/2001 Inoue et al. ..... 123/90.17
6,334,414 B1 1/2002 Okada et al.
6,378,476 B2 * 4/2002 Okada et al. ..... 123/90.17
6,439,182 B1 8/2002 Sugiura et al.
6,439,183 B1 * 8/2002 Iwasaki et al. ..... 123/90.17
6,779,499 B2 8/2004 Takenaka et al.
2001/0054406 A1 12/2001 Okada et al.
2002/0040697 A1 4/2002 Sugiura et al.
2002/0139332 A1 10/2002 Takenaka
2004/0226527 A1 11/2004 Borraccia et al.
2006/0201463 A1 9/2006 Schweizer

FOREIGN PATENT DOCUMENTS

DE 196 23 818 12/1996
DE 196 06 724 8/1997
DE 197 42 947 4/1998
DE 100 38 082 3/2001
DE 101 49 056 7/2002
DE 102 13 831 11/2002
DE 10 2005 004 281 1/2006
JP 2001050018 2/2001

* cited by examiner

*Primary Examiner*—Ching Chang
(74) *Attorney, Agent, or Firm*—Lipsitz & McAllister, LLC

(57) ABSTRACT

The present invention describes a new rotor and a corresponding method of manufacture for a rotor according to the invention in which a sleeve as a structural component takes over oil guidance functions in addition to locking pin bearing functions, wherein the sleeve can be inserted in a vane of the rotor flush with the surface by means of a press fit.

13 Claims, 8 Drawing Sheets

A-A

B-B

A-A

ROTOR OF A CAMSHAFT ADJUSTER

Figure 1:
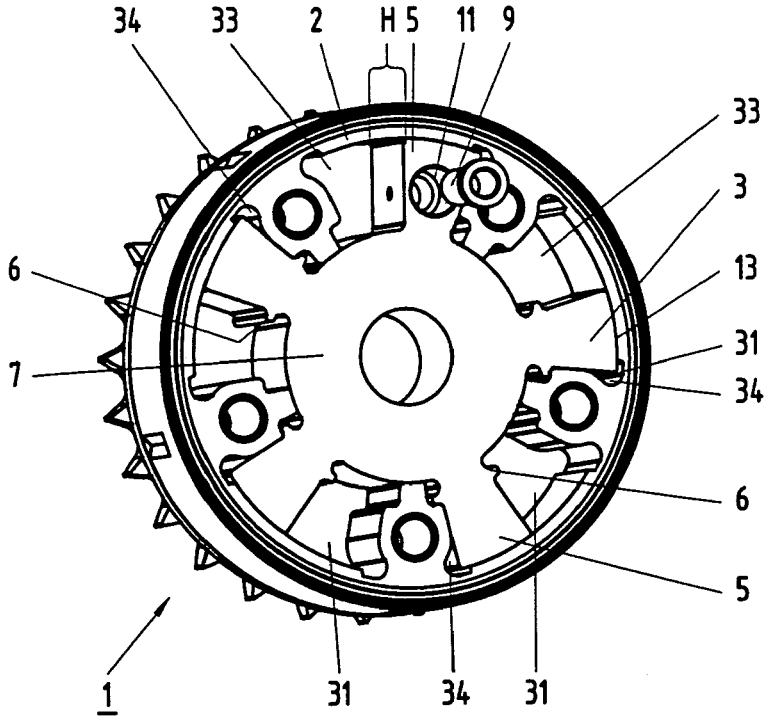

The present application claims priority of German application number 10 2006 002599.7 filed on Jan. 18, 2006; German application number 10 2006 019435 filed on Apr. 24, 2006; and European application number 07100664 filed on Jan. 17, 2007, each of which is incorporated herein by reference in its entirety for all purposes.

The invention relates to a locking opening of a rotor of a camshaft adjuster, in particular locking openings with locking pins in swivel-motor-type camshaft adjusters.

Modern motor vehicles are nowadays usually fitted with one or more camshaft adjusters. Camshaft adjusters are rotatory transmission elements which can adjust the relative phase angle between a driving shaft and a driven shaft relative to one another. For internal combustion engines, the opening and closing time of the gas reversing valve in relation to the crankshaft is adjusted by means of the camshaft adjuster, usually hydraulically.

Camshaft adjusters operating according to a helical toothed principle and camshaft adjusters operating according to a swivel-motor principle are encountered particularly frequently. While camshaft adjusters with a helical toothed structure exhibit a certain self-inhibition or self-persistence due to the helical toothed structure, the oscillating-motor-operated camshaft adjusters are so easy-running that a separate locking mechanism must be provided for a preferred position, which is to be adopted for example, in a switched-off, particular load state or starting state of the internal combustion engine.

Numerous locking mechanisms are known, which frequently can be summarized in that a pin is mounted retractably in the rotor and can thus bring the loosely rotationally mounted second component of the camshaft adjuster, the stator, into engagement with the rotor. During the engagement time the hydraulic pressure in the hydraulic chambers formed between the rotor and the stator has no influence on the positional variation of the rotor with respect to the stator. Rotor and stator turn almost synchronously with respect to one another during locking in their locking position, driven by an external drive.

When the lock is inserted, this is the state to which rotor and stator are freely movable with respect to one another in a certain angular relationship, a relative pressure difference between opposedly acting hydraulic chambers leads to a relative twist of the driving shaft relative to the driven shaft.

The patent literature contains numerous considerations as to how a locking opening and a suitable locking pin can be configured so that engagement between rotor and stator can be successfully ensured under various operating conditions such as hot running, idling, low pressure, even at high adjustment speeds. Many drafts primarily have in mind a particularly ingenious design based on the respective rotor production technology in order to allow, for example, noise behavior, error tolerance or increased mobility. For example, the following documents may be cited, DE 196 06 724 A1 from INA Wälzlager Schaeffler KG, DE 196 23 818 A1 from Nippondenso Co, DE 197 42 947 A1 from DENSO Corporation, DE 100 38 082 A1 from DENSO Corporation, DE 101 49 056 A1 from DENSO Corporation and JP 2001050018 A from DENSO Corporation. Locking openings configured as a blind hole can be seen in many documents. The bore blind-hole formation in the region of the reference numerals 19 and 51 can be seen particularly well in the figures of U.S. Pat. No. 5,960,757 from Nippondenso Co. Ltd.

From this it can be deduced that the rotor is initially manufactured in a first production step to produce its external dimensions by cutting from an extruded profile or by turning and in a next step a blind hole is drilled in the vane of the rotor. As a result, this has the consequence that the rotor component must be rechucked several times, whereby both the machining expenditure increases and the fault susceptibility also increases with each machining step. Furthermore, an increased material expenditure is provided because the drill must be changed, for example, after a certain number of drillings.

Figure 5:
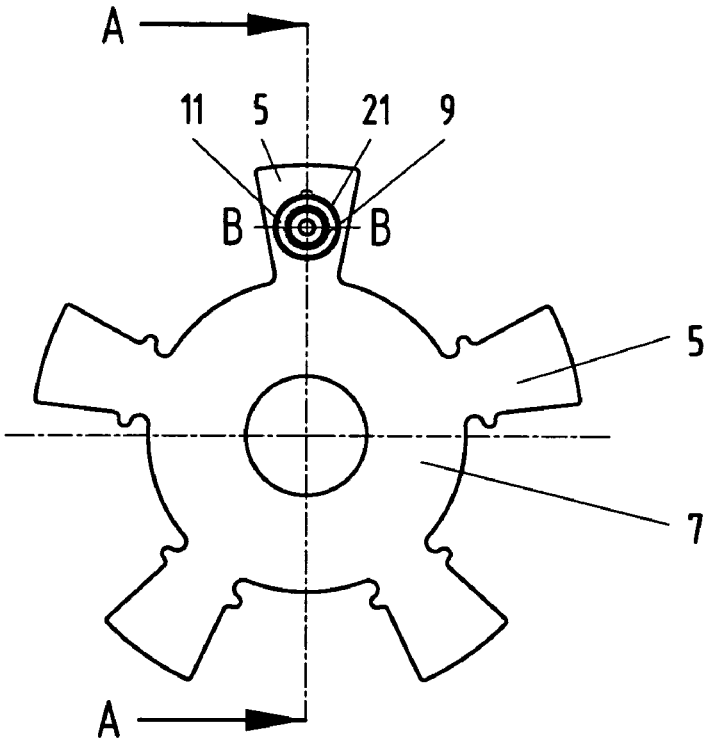

The use of a stepped bore or possibly also a two-sided bore or suitable other mechanically lifting forms of manufacture, for insertion of parts of a locking module with locking pin can be deduced from FIG. 5 of the German Patent DE 10 2005 004 281 B3 filed on 28.01.2005 for the patent proprietor Hydraulik-Ring GmbH. The relevant patent family member U.S. 2006/201463A1 discloses that all the dimensions which are described in detail are to be found in the front part of the pin and in the region of the receiving hole for the pin, in the stator, but not in the region of the guide hole.

DE 102 13 831 A1, also published as U.S. 2002/139332 A1, from the Denso Corp., claiming priorities from 2001 and 2002, presents numerous academic exercises as to how a camshaft adjuster of an uncontrollably switched-off engine, with a plurality of pistons, can be locked which should prevent the connected camshaft from adopting a lag position with respect to the crankshaft. The schematic example from FIG. 9 thus shows a design exercise whose practical implementation in automobile construction encounters numerous difficulties. One of the pistons is arranged in the stator and is therefore fixed. The rotor is partly at a distance in the area of the sleeve of the piston even in the stop position.

The use of a ring as an insertion piece in the stator before the priority date, 16 May 2003 of the U.S. Application U.S. 2004/0226527 A1 by Delphin Technologies Inc. has already been frequently used in the professional world but has a large play as a centering aid so that the locking pin has a trapping probability at higher angular velocities. In this case however, the ring does not guide the locking pin in the sense of the present invention but has only slight locking properties.

U.S. 2001/054406 A1 (Applicant: Okada et al.), in particular paragraph 36, describes how a sliding sleeve can be pressed into the rotor to improve the sliding guidance of the pin.

It is advantageous to design a locking mechanism which can in fact be produced as a part suitable for automobiles. In this connection, the problem is kept in mind to configure a lock, preferably in a rotor blade using as few as possible and simply shaped parts in such a manner than the locking mechanism can be manufactured or produced reliably and simply.

The object according to the invention is achieved by a rotor according to claim 1, claim 9 shows how the camshaft adjuster according to the invention is configured, and a suitable manufacturing method is described according to claim 10.

The rotor of a camshaft adjuster frequently lies inside the stator which, together with corresponding covers, forms a closed chamber, an intermediate space being provided between rotor and stator in the case of camshaft adjusters according to the swivel motor principle in order to be able to create pressure chambers which are variable according to their size. In the unlocked state, rotor and stator change their position when a hydraulic medium which can be introduced into the pressure chambers increases the pressure in specific pressure chambers while a relatively lower pressure is established in the counteracting pressure chambers. In order to increase the effect of the swivel principle, a plurality of vanes is usually configured, for example 5, which are rotatably arranged between webs of the stator at a certain angle of rotation, such as, for example 20 to 25 degrees. Locking mechanisms are provided in some vanes, which can comprise a locking pin and a locking opening and further components, such as a spring for example. Under the action of a corresponding pressure which can counteract a pre-clamping force, the locking pin returns to its withdrawn, unlocked position. The vanes frequently go over into a rotor core which forms a circular structure and in which the driven shaft, for example, the camshaft can engage. When the rotor is arranged with respect to the stator, for example in such a manner that the rotor is in its rest position, the locking pin can be withdrawn over the rotor surface. The locking opening itself is a through hole which is provided continuously, completely without interruption through the length, preferably the height. The through hole has at least two different cross-sections. Should the cross-sections describe approximately circular openings, the mean diameter can be determined. The diameters differ from one another. A stepped through hole is formed. In this case, the diameters can be selected in such a manner that they form partially superposed circular disks or that one of the diameters can go over almost completely into the other diameters. Optionally, further diameters can also be selected, for example a very small diameter of a semicircle which can be considered to be a continuation of the largest diameter of the cohesive hole. In precisely the same way, however, other shapes such as ovals, shaped openings and star shapes can occasionally be advantageous, then we talk of a cross-section. The description of the diameters should be applied to the cross-sections in an equivalent manner.

A favorable embodiment of the through hole is obtained if the larger cross-section is obtained from the diameter of a circular hole plus the distance of a lateral protuberance. According to one embodiment, the lateral protuberance only extends over a few angular degrees, e.g. less 15° or 20°, of the larger circular hole. In section, the through hole in the area of the larger cross-section resembles a mathematical fractal with two centers or a snowman consisting of two spheres.

In the sense of this invention, the distance from one position on the wall to the next selected position, preferably exactly opposite, is designated as the diameter. If the through hole is characterized by two different diameters, this means that in the section of the second diameter, two points can be found on the wall of the through hole which have a different distance from all the distance measurements in the part of the through hole of the first section.

A sleeve is inserted in the locking opening. The sleeve is located in a press fit. The press fit is formed between the sleeve wall, preferably an outer wall and the surface wall of the locking opening in a circular-arc section. In a further circular-arc section the sleeve is located in a self-supporting state so that the sleeve serves as a dividing wall. The sleeve is inserted completely into the rotor. Said sleeve ends below the surface, alternatively at the surface of the rotor, wherein the sleeve is not completely continuous through the height of the rotor. The sleeve itself is a simple circular object, without numerous gradations, therefore continuous. The simple configuration of the through hole of the locking opening and the simple configuration of the sleeve minimizes the susceptibility to error, the simple formation of the press fit which predefines a simple defined insertion depth, also contributing to this.

The circular sleeve serves as a sliding bearing for the retractable locking pin. It is provided with a smooth surface so that the locking pin can be withdrawn and inserted easily in the sliding bearing. Any canting is thus prevented.

Insertion of the sleeve into its press fit can furthermore be facilitated if a stop flange is provided at one end, preferably at the end of the side nearer to the surface of the rotor so that a maximum pressing-in depth is predefined. In such a case, the locking opening can advantageously be configured as a two-stepped through opening. The first step lies very close to the surface, being located as far inside the vane of the rotor as the thickness of the stop flange. The next step lies so far inside the vane that the pressed-in sleeve which ends with the surfaces does not reach the step.

The sleeve in the rotor with its section not lying in the press fit forms a dividing wall which separates a supply channel from the sliding surface of the locking pin. The supply channel leads to a collar of the locking pin. According to an exemplary embodiment, the locking pin hits against the sleeve with the collar. The sleeve hereby takes over several functions, a channel-forming function, a sliding function and one or more stop functions. The term collar is understood in the present description of the invention in the sense that it designates a hydraulically suppressible arc which is formed, for example, in the transition of groove to the head of the locking pin. The groove is configured as a hydraulic medium receiving space into which the hydraulic medium flows in order to lift the locking pin from the locking opening by means of pressure. The collar is the region of the pin which can be arc-shaped below which the oil present as hydraulic medium in the groove can push.

The supply channel is longer than the sleeve. However, the supply channel is not completely continuous through the vane. It ends in a central zone, inside the vane. The supply channel can advantageously be represented by the second, shorter diameter. The sleeve has a length such that it can preferably completely enclose the stem of the locking pin when the stem projects partly from the vane in its withdrawn position. The sleeve should be considered to be a supporting sleeve in this state. The length of the sleeve is such that an underflow region of the collar can remain. The supply channel is communicatively connected in relation to a hydraulic medium to an inflow channel which can in turn be supplied from a pressure chamber between rotor and stator of the camshaft adjuster. The design described contributes to the security of the locking pin supply.

In an alternative exemplary embodiment, an almost tetragonal notch is formed from the sleeve, which serves as an interruption of the hydraulic medium from the supply channel to the underflow region of the pin. The supply channel has a length. The length can be shorter than the length of the sleeve. However, it can also be approximately the length of the sleeve. The length is therefore shorter or up to the same length as the length of the sleeve, the sleeve being provided with a notch or stamped section at one of the two ends in the area to the supply channel.

If the rotor vane is broken down into individual layers, it can be ascertained that the different diameters are given in different layers of the vane. Starting from one side of the rotor, initially all the diameters can be found there, with continuing direction onto the opposite side of the rotor, individual diameters can no longer be found there as openings. It contributes towards the particular manufacturability of the rotor if the rotor is a sintered component.

Rotor and stator together with further components form a camshaft adjuster. The rotor which can be executed as a sintered part lies smoothly and at the same time, resistant to friction in the stator of the camshaft adjuster which forms a receiving hole for the locking pin which runs smoothly in the sleeve.

A suitable method for manufacturing a rotor of a camshaft adjuster according to the invention consists in first loading a rotor sinter mould with a quantity of metal powder comprising approximately twice to three times, preferably 2.5 times the amount, particularly favorably in the direction of the rotor height. The height of the rotor is the short side of the rotor. The metal powder is sintered, the rotor sinter mold comprising a stamp having at least two different diameters. The stamp creates the locking opening. The term stamp also includes a divided stamp whose first part creates the locking opening and whose second part creates the protuberance for the supply channel. A different stamp form consists of a contour through which both longitudinal opening shapes can be created simultaneously, within one working process. The locking opening is created at the same time during sintering. Thereafter, the sleeve, which can function as a bearing among other things, is pressed flush into the vane of the rotor so that a supply channel is formed on that side of the sleeve while on this side, the running surface for the locking pin is created inside the sleeve. The locking pin having a circumferential horizontal collar is inserted from the other side, from the side from which the locking pin has not been inserted, the side facing away from the sleeves. The circumferential horizontal collar is located at an angle to the direction of movement, the direction of withdrawal of the locking pin. The horizontal collar is located in the section facing away from the sleeve.

A calibration and preferably a grinding of the surfaces, in particular exclusively the front faces, of the rotor can be carried out between the sintering step and the pressing-in of the sleeve. If the surface cannot be produced in a very sharply defined manner by the sinter mold, calibration and optionally the surface treatment by a removal method helps substantially to ensure dimensional stability.

An advantage of the method described in that the rotor, including its opening for receiving locking elements, is created in a shaping production process comprising a single step, the surface of the rotor including its protuberances and recesses being created at the same time, coherently during the pressing process. A subsequent drilling machining which removes parts of the rotor material, is superfluous due to the formation of the outer contour and the inner contour of the rotor. A closed surface of the rotor is formed, which extends from the front faces of the rotor via the locking opening to the transverse faces of the rotor as a closed path.

When the finished locking element, a locking pin is installed, according to one exemplary embodiment this can be supported on a spring collar by means of a spring element which forms an at least partial, if not complete closure of one side of the surface of the rotor so that the combined surface consists of two parts, a sintered rotor vane and an inserted spring collar firmly connected to the rotor.

Figure 2:
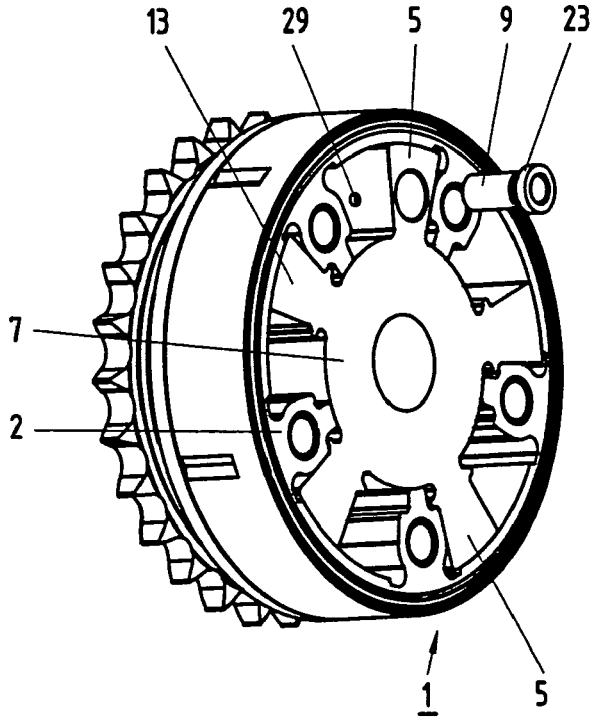
Figure 3:
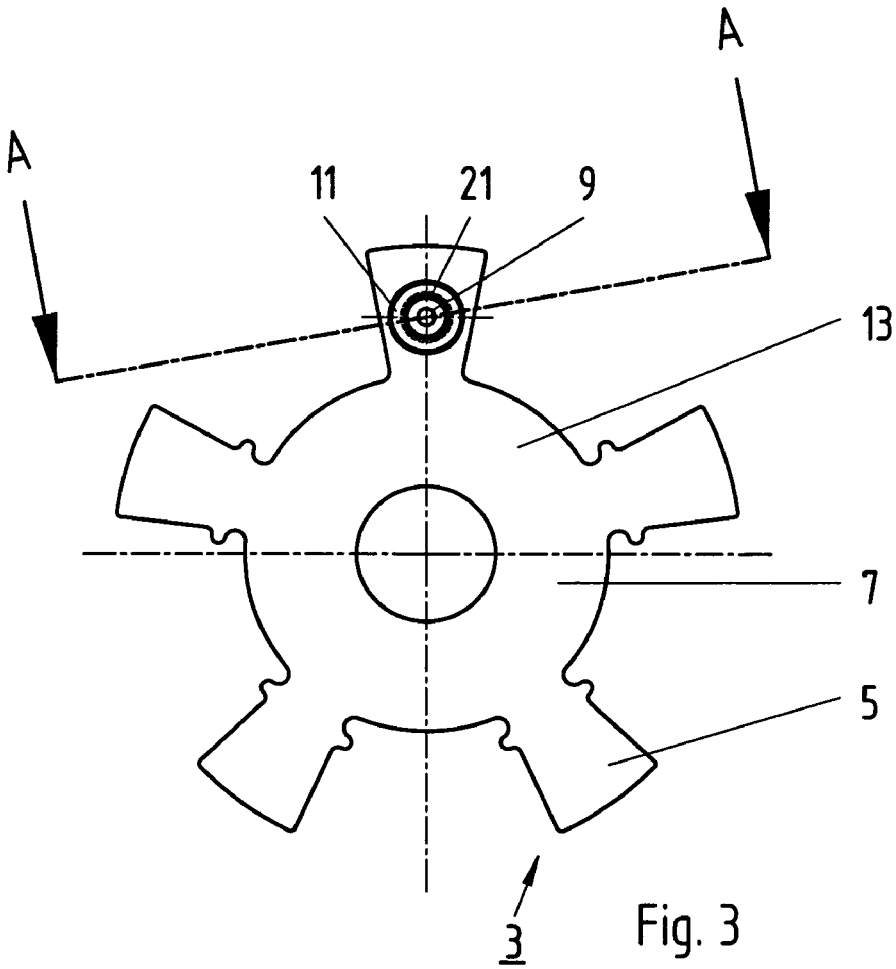
Figure 4:
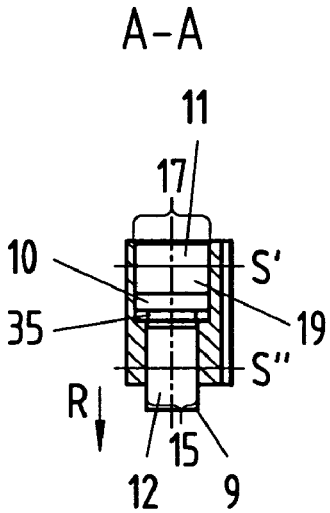
Figure 6:
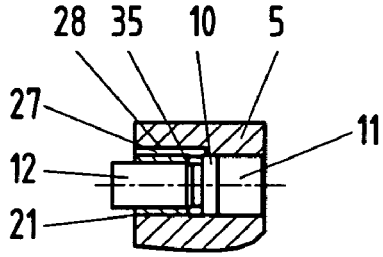
Figure 7:
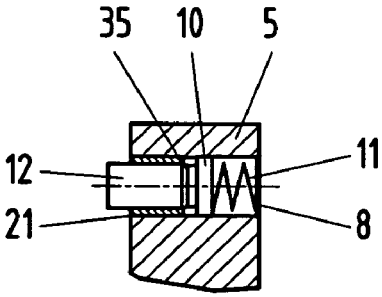
Figure 8:
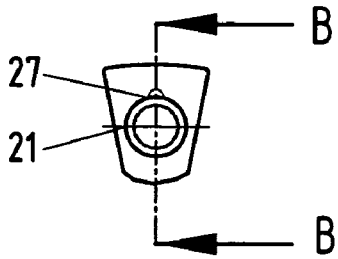
Figure 9:
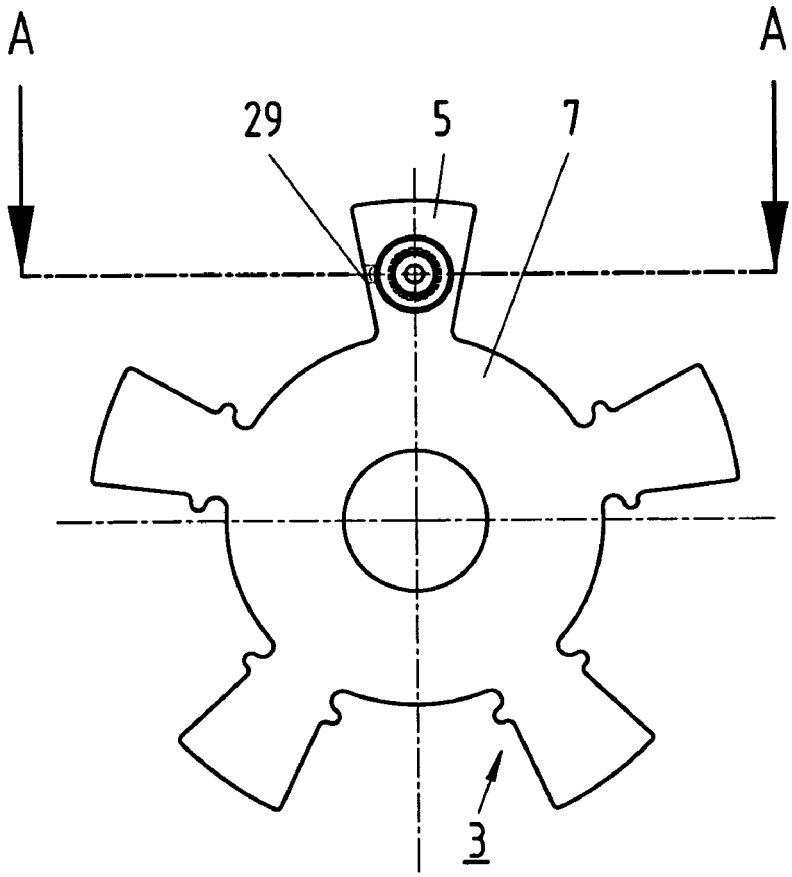
Figure 10:
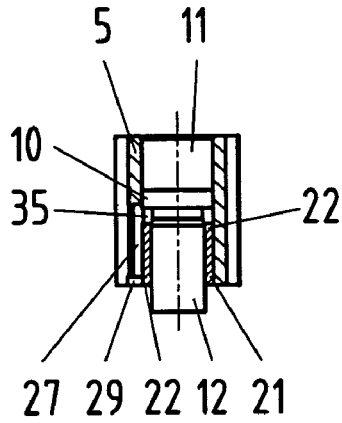
Figure 11:
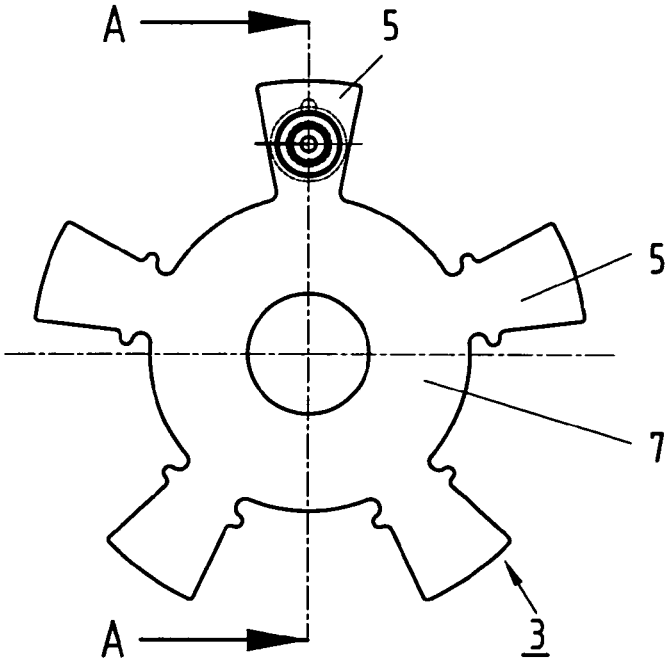
Figure 12:
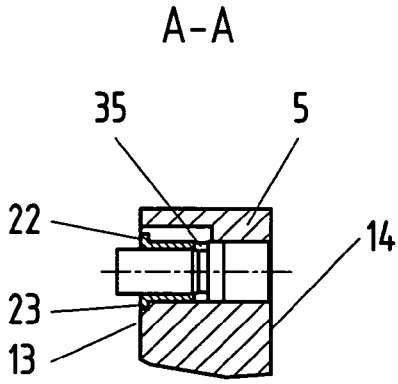
Figure 13:
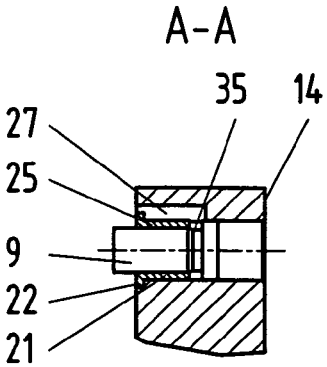
Figure 14:
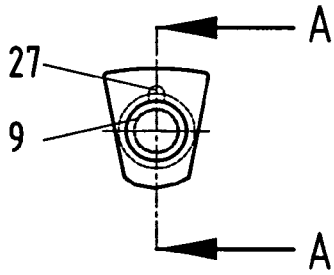

The invention can be better understood by reference to FIGS. 1 to 10 , wherein FIG. 1 shows a camshaft adjuster with conventional machining technology, FIG. 2 shows the camshaft adjuster from FIG. 1 from a rotated perspective, FIG. 3 shows a rotor of a camshaft adjuster from a plan view, FIG. 4 shows a section through a vane of a rotor according to FIG. 3, FIG. 5 shows a rotor similar to FIG. 3 with a supply channel according to the invention, FIG. 6 shows a section through a part of a vane of the rotor from FIG. 5, FIG. 7 shows a section similar to FIG. 6 through a part of a vane of a rotor with modified dimensions, FIG. 8 shows a front view of a vane part section of rotor from FIG. 5, FIG. 9 shows another embodiment of a rotor according to the invention and FIG. 10 shows a section through a vane of a rotor according to FIG. 9.

FIGS. 11 to 14 disclose another exemplary embodiment.

Figure 15:
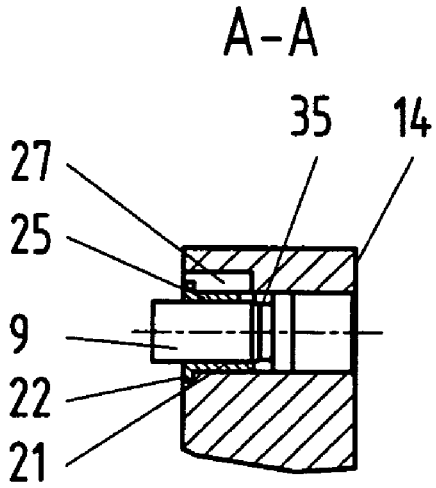
Figure 16:
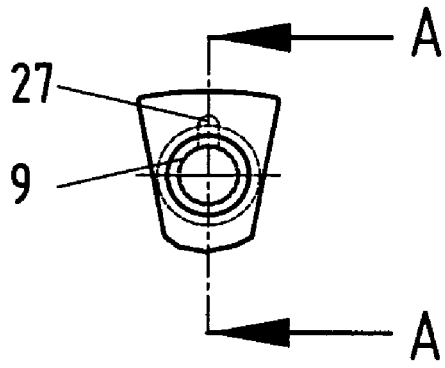

FIGS. 15 to 16 show another embodiment of a sleeve according to the invention.

Figure 17:
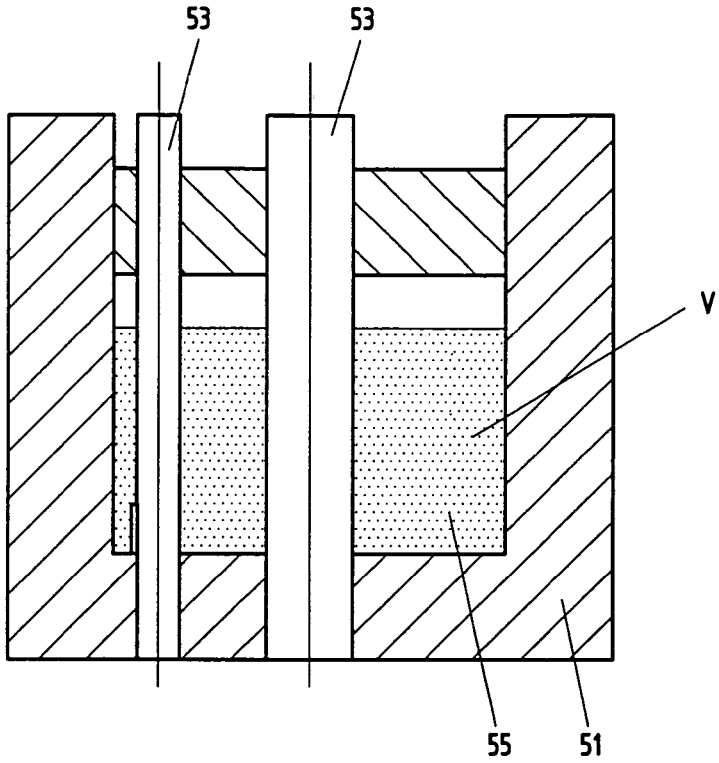
Figure 18:
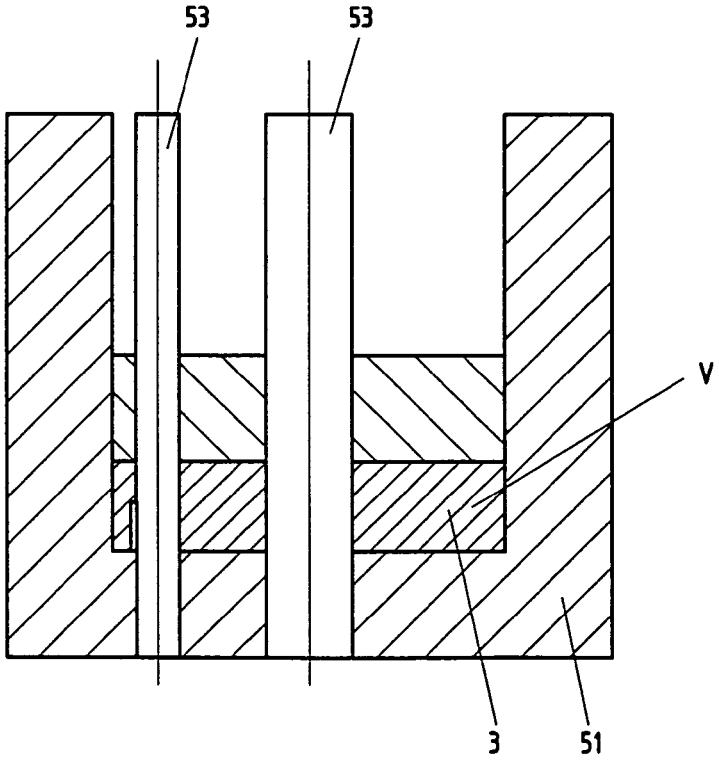

A manufacturing method according to the invention is shown graphically in FIGS. 17 and 18.

Figure 19:
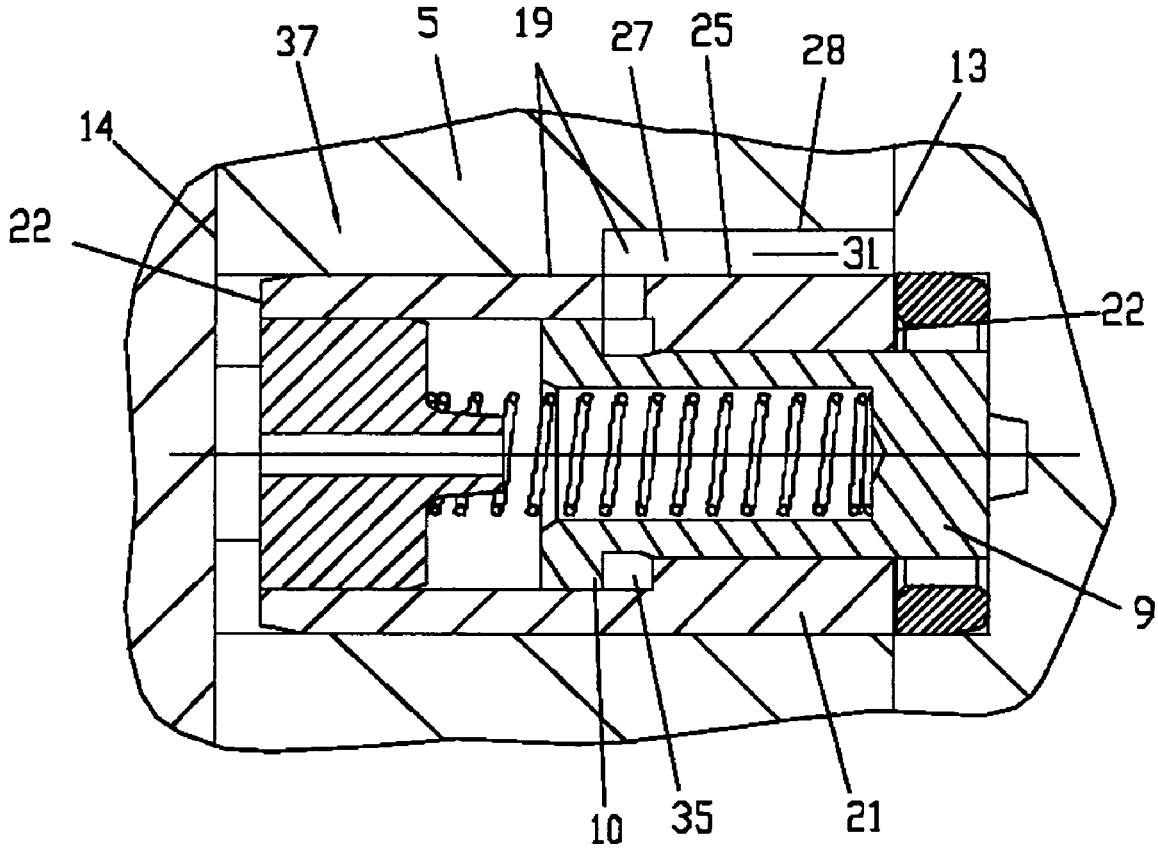

FIG. 19 shows a pin module according to the invention in which the sleeve can be pressed together with the locking pin and other components.

FIGS. 1 and 2 show an opened camshaft adjuster 1 comprising a rotor 3 and a stator 2 which operates according to the principle of a hydraulic swivel motor. The rotor 3 has a rotor core 7 and a certain number, in the present example five, of vanes 5 which can be configured as partly identical to one another. Some of the vanes 5 have additional functional elements such as, for example, damping members, hammer shapes, pressure compensating channels, underflow channels or increased sealing lengths. One of the vanes 5 is fitted with an additional functional element, locking opening 11. The rotor 3 is shown with one vane without lateral damping restrictions 6 which has the locking opening 11 and four vanes 5 having lateral damping restrictions 6. The term "lateral" means the sides of the vane located approximately at right angles to the rotor surface 13 which frequently are the shorter sides of the vanes. However, it is also conceivable that a plurality of functional elements are combined in one vane or that a plurality of vanes exhibit one locking opening 11. The vanes 5 separate different pressure chambers 33, 34 which are formed on each shorter side of the vane 5 and are formed between pivoting vanes 5 and webs 4. The pressure chambers 33, 34 which are provided as oppositely configured, oppositely acting chambers are varied according to their width by swiveling the vanes 5. The change in width is accompanied by a change in volume of the pressure chambers 33, 34. At the side, an inflow channel 29 leads to one of the pressure chambers 33, 34. The pressure chambers 33, 34 are filled with a hydraulic medium 31, such as engine oil for example.

The locking opening 11 in FIGS. 1 and 2 is produced using a conventional drilling method. The result of the manufacturing method by means of double drilling with different drill sizes or step drilling using a single step drill shows a locking opening 11 into which a sleeve 21, preferably the press fit, can be inserted. The openings with different diameters end with a different diameter on one side of the vane 5, the rotor surface 13, than on the other opposite side 14 of the same vane 5. The locking opening 11 lies approximately centrally on the rotor surface 13 of one vane 5, forming the broad side of the rotor 3. Most of the vane width is removed from the vane 5 by the drilling. The different diameters lies substantially coaxially parallel to the camshaft axis. The sleeve 21 has a stop flange 23. The locking opening 11 is continuous through the height H of the rotor 3, which represents the shorter height. The locking opening 11 is stepped. The step is the result of a stepped drilling. The stop flange 23 of the sleeve 21 lies on the step. A supply channel 27 from a pressure chamber 33 into the locking opening 11 points from the side forming the height side of the rotor 3. The supply channel 27 is located approximately at half the height of the rotor 3. The supply channel 27 opens at the step of the locking opening 11. The locking opening 11 is a circular through hole. The sleeve 21 has an outside diameter larger than the bore diameter of the section having the smaller opening diameter. The sleeve 21 sits in the press fit in the opening section with the smaller diameter. The stop flange lies on the shoulder formed between the two successive diameters.

FIG. 3 shows the rotor 3 without its stator 2 in a front view, which shows the observer one of the large-area rotor surfaces 13. Vanes 5 are uniformly distributed around the rotor core 7 over its circumference. The continuous locking opening 11 with its locking pin 9 which extends from one rotor surface 13 onto the opposite rotor surface 13, is located in the vane which is provided laterally, at an angle from the rotor surface 13, without further contours, merely by a perpendicular smoother shorter, almost tetragonal surface. The pin 9 runs in the sleeve 21.

The locking opening 11 is shown in greater detail in FIG. 4. The locking pin 9 comprising a collar 10 and a stem 12 is mounted so that it can slide in the locking opening 11. The locking pin 9 is inserted in the through hole 19 which has two different diameters 15, 17 which lie in different layers S, S', S". The collar 10 has a larger diameter than the stem 12. Collar 10 and stem 12 lie above one another in the same flight on the same axis, they are formed coaxially in one piece. The locking opening 11 runs from one side of the rotor surface starting from a cross-section which is so large that it guidingly receive the stem, as far as approximately the height layer of the vane in which a lateral inflow channel 29 opens. Below the underflow region 35, the cross-section of the locking opening 11 tapers to the cross-section of the stem 12. The tapering can be provided by a circular, rotationally balanced sleeve which spans the entire circumference. The sleeve forms a stepped locking opening whose cross-sections narrow to the stem cross-section along the height H. The pin 11 moves in the direction of withdrawal R.

As can easily be seen from the plan view in FIG. 3, the sleeve 21 has a smaller diameter than the widest position of the locking opening 11 and a larger inside diameter than the outside diameter of the stem 12 of the locking pin 9. The inflow channel 29 extending below the collar 10 guides hydraulic medium under the collar 10 so that the hydraulic medium drives the collar and therewith the pin emerging therefrom in the space of the broader diameter of the locking opening 11.

A further exemplary embodiment can be seen in FIGS. 5 to 8. Similar parts as in FIGS. 3 and 4 can be explained similarly, as has already been put forward for reasons of legibility. In one vane 5 of the protuberance emerging from the rotor core 7, the locking opening 11 is again provided with its locking pin 9. The locking opening 11 overall looks somewhat more complex than the exemplary embodiment in FIGS. 3 and 4, wherein the production of the form shown is carried out just as simply. The basic form of the locking opening 11 is a circular hole with lateral recess, e.g. aligned toward the outside of the vane or toward the furthest side of the vane, which is preferably likewise provided over the total rotor height. From the front side, the opening resembles a fractal with two mid-points. The sleeve 21 is inserted in the opening. The sleeve 21 forms an inner sliding bearing region constructed for the stem 12 of the locking pin 9 and an outer region which, as supply channel 27, is provided with a significantly smaller diameter than that of the locking pin 9. The supply channel 27 opens approximately centrally in the vane 5 in the underflow region 35 of the locking pin 9. The underflow region 35 is formed at least partially circumferentially around the substantially round pin by an insertion depth preceding the collar 10 of the locking pin 9. The collar 10, comprising a horizontal stop collar, delimits the hydraulic medium of the supply channel and the underflow region 35 toward the opposite pressure side on the locking pin 9. The sleeve 21 sits in a partially contacting press fit in the opening of the rotor 3 whose self-supporting section is at the same time a part of the supply channel 27. Further parts of the supply channel 27 are formed by the wall 28 constructed from the vane 5. The sleeve 21 thus takes over two tasks in a two-function manner, that of the sliding bearing and that of oil guidance. As can be seen from FIG. 7, the pin 9 is spring-prestressed by the spring 8.

The exemplary embodiment according to FIG. 9 and FIG. 10 shows a similar structure to that in FIGS. 5 to 8, where the supply channel 27 extending in an elongated manner at the height of the rotor 3 is supplemented by a lateral inflow channel 29 pointing out from the vane 5, which allows the locking pin 9 which runs in sections in the locking opening 11 to be supplied with hydraulic medium from the hydraulic chambers (see the reference numerals 33, 34 in FIGS. 1 and 2) between the vanes 5 of the rotor 3. The inflow channel 29 is parallel-defined flat right-angled channel configured on the shortest path which ends at the sleeve 21 or one of the ends 22 of the sleeve 21. In order to reach below the collar 10 with its underflow region 35, the hydraulic medium runs through different flow-through regions whose flow directions are multiply deflected compared to the vane 5 of the rotor 3. The deflections help toward propagation of the pressure during pressure changes with almost quiescent hydraulic medium. A vane 5 thus described is singly or multiply suspended on the rotor core 7. The stem 12 of the pin is slidingly mounted on the inside of the sleeve.

The exemplary embodiment in FIGS. 11 to 14 shows a rotor 3 according to the invention with five rotor vanes 5 around a rotor core 7, in one rotor vane 5 whereof a locking pin 9 is inserted in a sleeve 21. The sleeve 21 is defined in its insertion depth by a stop flange 23 in such a manner that the sleeve 21 ends with its stop flange 23 surface-flush with the rotor surface 13. The stop flange 23 is formed at one end 22 of the sleeve 21. The opposite surface 14, the facing-away surface 14 of the rotor 3 shows only one locking opening 11. The circular sleeve 21 has a likewise circular stop flange 23 which, however, in an alternative exemplary embodiment can also be present only as a circular arc. In the exemplary embodiment shown in FIG. 13, the stop flange 23 narrows the inflow channel 29 slightly at the surface 13 of the rotor 3. The supply channel 27 then extends uniformly into the underflow region 35. In the withdrawn position of the locking pin 9, underflow can take place in the underflow region 35. At the same time, a partial section of the outer wall 25 of the sleeve 21 forms a region of the inner wall of the supply channel 27.

An alternative embodiment is shown in FIGS. 15 and 16. In particular, the supply channel 27 with the sleeve is configured somewhat differently in its length than in the exemplary embodiments previously. The sleeve 21 has a notch at the end. At the other end 22 of the sleeve 21, a border is provided in the direction of the outer wall 25 of the sleeve 21. A connection between the supply channel 27 and the underflow region 35 of the locking pin 9 is provided by the protuberance in a circular section of the sleeve 21. The supply channel is shorter than or the same length as the sleeve. This arrangement has the advantage that manufacturing tolerances can be intercepted more easily. However, attention must be paid to ensure that the sleeve is always inserted correctly in the sense of its orientation in the locking opening 11. The entire arrangement is located at a suitable position of the vane 5 as in the similar exemplary embodiments.

FIGS. 17 and 18 show a sintering process of a production step of a rotor 3 according to the invention in FIGS. 1 to 14 in a rotor sinter mold 51 with locking opening 11 for subsequent insertion of a sleeve 21. The rotor sinter mold 51 has at least two stamps 53 of which the larger stamp is located at the center of the rotor sinter mold 51. This forms the axial connection of the camshaft adjuster to the camshaft. At the side, a stamp 53 pierces the rotor 3 which can either be fitted with a thicker section for the supply channel or forms a further part stamp. The metal is powder 55 is compacted after loading the rotor sinter mold 51. Usually about twice the volume V of the rotor 3 is filled with the metal powder 55. The metal powder 55 is pressed as shown in FIG. 16. The sleeve 21 can be pressed in afterwards. When the locking pin 9 is inserted, the rotor 3 is finished after an optional grinding process.

FIG. 19 discloses an exemplary embodiment which can be inserted as a complete module 37 in the through hole 19 of the rotor 5 in the press fit. Starting from one of the two rotor surfaces 13, 14, as in the examples described previously, the supply channel 27 is aligned to the horizontal center of the rotor 5. In the exemplary embodiment, the supply channel 27 is arranged almost or actually at right angles to the surface 13. The supply channel 27 is formed as an at least partly completely enclosed and sealed channel whose walls are obtained from a longitudinal region of the sleeve 5 which preferably only occupies and covers a small circular segment of the sleeve 21, and from inner walls of the rotor 5 of the through hole 19. Thus, one wall, namely the outer wall of the sleeve 5 is curved. At the end of the supply channel 27 which does not go over the total height H of the rotor 5, the sleeve is broken through or interrupted in order to guide the hydraulic medium 31 in the underflow region of the locking pin 9, in particular in the region below its collar 10. According to an advantageous embodiment, the sleeve 5 does not extend over the entire height H but the ends 22 terminate below the corresponding surface 13 or 14, at least on one side. The supply channel 27 is defined by the outer side, the outer wall 25, the sleeve 21 and the walls 28 of the hole 19. The supply channel 27 runs parallel to the sleeve 5. As in the examples discussed previously, the broader diameter of the through hole 19 ends in the region, in particular below the maximum withdrawal position of the collar 10 of the locking pin 9 to make the underflow region 35 of the locking pin 9 accessible.

Even though only a few exemplary embodiments have been presented, it is understandable that naturally any combinations of the sleeve 21 can be selected with an arbitrary number of locking openings 11 in a plurality of vanes 5, wherein some sleeves 21 with and without a stop flange 23 can be fitted. The advantage of the invention is that the sleeve can be used multifunctionally, being inserted easily in the rotor as a simple shaped part to further develop a locking opening at the same time to guide the locking pin. The rotor can be manufactured as a sintered part, whereby the afterprocessing steps can be reduced to a minimum. For example, hardly any drilling machining with their clamping processes is required. The sleeve 21 is not only a filling part but the sleeve 21 is a guide part for the locking pin 9 and the sleeve 21 is a functional part for forming the supply channel 27 of the rotor 5.

The present invention relates to a new rotor and a corresponding method of manufacture for a rotor according to the invention in which a sleeve as a structural component takes over oil guidance functions in addition to locking pin bearing functions, wherein the sleeve can be inserted in a vane of the rotor flush with the surface by means of a press fit. In this case, according to a preferred exemplary embodiment the sleeve does not extend completely from surface to surface of the rotor but ends below the surface.

Reference List

| | |
|---|---|
| 1 | Camshaft adjuster |
| 2 | Stator |
| 3 | Rotor |
| 4 | Web |
| 5 | Vane |
| 6 | Damping restriction |
| 7 | Rotor core |
| 8 | Spring |
| 9 | Locking pin |
| 10 | Collar of locking pin, in particular horizontal collar |
| 11 | Locking opening |
| 12 | Stem |
| 13 | Rotor surface |
| 14 | Facing-away surface |
| 15 | First cross-section, preferably diameter |
| 17 | Second cross-section, preferably diameter |
| 19 | Hole |
| 21 | Sleeve |
| 22 | End of sleeve |
| 23 | Stop flange |
| 25 | Outer wall of sleeve |
| 27 | Supply channel |
| 28 | Wall |
| 29 | Inflow channel |
| 31 | Hydraulic medium |
| 33 | Pressure chamber, first type |
| 34 | Pressure chamber, second type |
| 35 | Underflow region |
| 37 | Locking module |
| 51 | Rotor sinter mold |
| 53 | Stamp |
| 55 | Metal powder |
| H | Height |
| R | Withdrawal direction |
| S,S'S" | Layer |
| V | Volume |

The invention claimed is:

1. A rotor of a camshaft adjuster, comprising:

a rotor core;

a plurality of vanes emanating from the rotor core, and a locking pin which is guided in a locking opening and adapted to be withdrawn from a rotor surface, wherein:

the locking opening is a stepped hole which is provided with at least two different cross-sections and which extends through one of said plurality of vanes of the rotor, said stepped hole bears a sleeve which forms a supply channel by means of an outer wall of the sleeve, in at least one of said cross-sections the sleeve fits in the locking opening in a press fit formed by a circular arc between the sleeve and a wall of the locking opening.

2. The rotor according to claim 1, wherein:

the sleeve is fixed in the locking opening below the surface of the rotor, and the locking opening is longer than the sleeve.

3. The rotor according to claim 1, wherein:

the sleeve is a circular sleeve which serves as a sliding bearing for the retractable locking pin, and a stop flange at one end of the sleeve determines a maximum pressing-in depth of the sleeve.

4. The rotor according to claim 1, wherein:

the supply channel is formed by the outer wall together with the wall of the locking opening formed by one of the two cross-sections of the locking opening, and the supply channel leads to a collar of the locking pin.

5. The rotor according to claim 4, wherein:

the supply channel is longer than the sleeve but shorter than the locking opening, and the sleeve completely surrounds a stem of the locking pin such that a part of the stem remaining in the vane is spanned by the sleeve minus an underflow region of the collar.

6. The rotor according to claim 4, wherein:

the supply channel has a length less than or equal to a length of the sleeve, and the sleeve is provided with one of a notch or a stamped section at one of two ends in an area of the supply channel.

7. The rotor according to claim 4, wherein the supply channel is supplied with hydraulic medium by an inflow channel provided on a vane surface from a pressure chamber of the camshaft adjuster.

8. The rotor according to claim 1, wherein the cross-sections occur in different layers of the vane.

9. The rotor according to claim 1, wherein the rotor is a sintered component.

10. A camshaft adjuster, comprising:

a stator; and a rotor, said rotor comprising:

a rotor core;

a plurality of vanes emanating from the rotor core, and a locking pin which is guided in a locking opening and is adapted to be withdrawn from a rotor surface, wherein:

the locking opening is a stepped hole which is provided with at least two different cross-sections and which extends through one of said plurality of vanes of the rotor, said stepped hole bears a sleeve which forms a supply channel by means of an outer wall of the sleeve, in at least one of said cross-sections the sleeve fits in the locking opening in a press fit formed by a circular arc between the sleeve and a wall of the locking opening; and a stator inner wall forms an inflow channel from a pressure region into the supply channel.

11. A method of manufacturing a rotor of a camshaft adjuster, comprising the following steps:

loading a rotor sinter mold with a quantity of metal powder which forms at least twice the volume of a supplied volume at a level of the rotor, the rotor sinter mold is adapted to form a rotor having a plurality of vanes emanating from a rotor core, said rotor sinter mold having a stamp adapted to create a locking opening extending through one of said vanes in the form of a stepped hole having at least two different cross-sections, pressing the metal powder in the mold to form said rotor with said locking opening, sintering the pressed rotor mold, flush pressing a sleeve functioning as a bearing into the locking opening, which sleeve forms a supply channel in the rotor, and inserting a locking pin provided with a spring into the sleeve, the locking pin having a circumferential horizontal collar which is disposed at an angle to the direction of withdrawal of the locking pin from a surface of the rotor facing away from the sleeve.

12. The method of manufacture according to claim 11, wherein between the sintering step and the pressing of the sleeve, a calibration and a grinding of the surfaces of the rotor is carried out.

13. A rotor of a camshaft adjuster, comprising:

a rotor core;

a plurality of vanes emanating from the rotor core, and a locking pin which is guided in a locking opening and adapted to be withdrawn from a rotor surface, wherein:

the locking opening is a stepped hole which is provided with at least two different cross-sections and which extends through one of said plurality of vanes of the rotor, said locking opening bears a sleeve, a supply channel is formed by an outer wall of the sleeve and walls of the locking opening, the sleeve separates the supply channel from a sliding face of the locking pin, and the supply channel runs, at least in sections, parallel to the sleeve.

* * * * *